US012180875B2

(12) United States Patent
Feyl-Narrain et al.

(10) Patent No.: US 12,180,875 B2
(45) Date of Patent: Dec. 31, 2024

(54) GAS INTRODUCTION ASSEMBLY FOR INTRODUCING GAS, IN PARTICULAR AIR, INTO AN EXHAUST GAS SYSTEM OF AN INTERNAL COMBUSTION ENGINE

(71) Applicant: Purem GmbH, Neunkirchen (DE)

(72) Inventors: Gita Feyl-Narrain, Esslingen (DE); Kresimir Jambrosic, Reichenbach an der Fils (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 18/346,710

(22) Filed: Jul. 3, 2023

(65) Prior Publication Data

US 2024/0003282 A1 Jan. 4, 2024

(30) Foreign Application Priority Data

Jul. 4, 2022 (DE) ..... 10 2022 116 565 .5

(51) Int. Cl.
*F01N 3/30* (2006.01)
*F01N 3/10* (2006.01)
*F01N 3/20* (2006.01)

(52) U.S. Cl.
CPC ..... *F01N 3/30* (2013.01); *F01N 3/10* (2013.01); *F01N 3/2026* (2013.01); *F01N 2240/16* (2013.01); *F01N 2610/10* (2013.01); *F01N 2610/102* (2013.01)

(58) Field of Classification Search
CPC ..... F01N 3/10; F01N 3/2026; F01N 3/30; F01N 2240/16; F01N 2610/102
USPC ..... 60/299, 300, 303, 307
See application file for complete search history.

(56) References Cited

U.S. PATENT DOCUMENTS

| | | | | |
|---|---|---|---|---|
| 4,404,795 | A | 9/1983 | Oishi et al. | |
| 6,167,699 | B1 * | 1/2001 | Johnston | F01N 3/34 123/456 |
| 7,032,376 | B1 | 4/2006 | Webb et al. | |
| 2008/0163612 | A1 * | 7/2008 | Gaiser | F01N 3/2033 60/299 |
| 2010/0077731 | A1 | 4/2010 | Jeong et al. | |
| 2015/0204223 | A1 | 7/2015 | Tsumagari et al. | |
| 2017/0067381 | A1 | 3/2017 | Gaiser | |
| 2019/0316549 | A1 * | 10/2019 | Notter | F01N 3/30 |
| 2021/0222605 | A1 | 7/2021 | Kurpejovic | |

FOREIGN PATENT DOCUMENTS

| | | | |
|---|---|---|---|
| DE | 10 2006 060 471 | A1 | 6/2008 |
| DE | 10 2015 114 723 | A1 | 3/2017 |
| DE | 10 2018 108 592 | A1 | 10/2019 |
| DE | 10 2020 101 134 | A1 | 7/2021 |
| JP | S53-66518 | U | 6/1978 |
| JP | S60-32516 | U | 3/1985 |
| WO | 2006/137695 | A1 | 12/2006 |

* cited by examiner

*Primary Examiner* — Jorge L Leon, Jr.
(74) *Attorney, Agent, or Firm* — Walter Ottesen, P.A.

(57) ABSTRACT

A gas introduction assembly introduces gas, in particular air, into an exhaust gas system of an internal combustion engine. The exhaust gas system has an interior. The gas introduction assembly includes a gas introduction region positioned in the interior of the exhaust gas system. The gas introduction region is constructed at least partially with porous material.

15 Claims, 4 Drawing Sheets

GAS INTRODUCTION ASSEMBLY FOR INTRODUCING GAS, IN PARTICULAR AIR, INTO AN EXHAUST GAS SYSTEM OF AN INTERNAL COMBUSTION ENGINE

CROSS-REFERENCE TO RELATED APPLICATIONS

This application claims priority of German patent application no. 10 2022 116 565.5, filed Jul. 4, 2022, the entire content of which is incorporated herein by reference.

TECHNICAL FIELD

The present disclosure relates to a gas introduction assembly for introducing gas, in particular air, into an exhaust gas system of an internal combustion engine.

BACKGROUND

Gas, such as, for example, air, can be fed into an exhaust gas system by such a gas introduction assembly. If the feeding of the gas is performed, for example, upstream of a heating unit and an exhaust gas treatment unit which is downstream of the heating unit, such as, for example, a catalytic converter or the like, heat provided by gas introduced via the gas introduction assembly into the exhaust gas system in the region of the heating unit can be absorbed in a phase in which an internal combustion engine is not yet in operation and thus no exhaust gas flows in the exhaust gas system and can be transported to the downstream exhaust gas treatment unit in order to bring it to a temperature in the range of an operating temperature required to carry out the generally catalytic exhaust gas cleaning reaction even before an internal combustion engine is put into service.

A gas/gas mixer which provides a gas introduction assembly is known from US 2019/0316549. The gas/gas mixer has a gas introduction body with a body wall with a multiplicity of gas passage openings formed therein in a gas introduction region. The gas passage openings are arranged in the body wall formed with a substantially droplet-like cross-sectional profile in a region oriented in a downstream direction so that substantially no exhaust gas can flow through the gas passage openings into the interior space of the gas introduction body.

SUMMARY

It is an object of the present disclosure to provide a gas introduction assembly for introducing gas, in particular air, into an exhaust gas system of an internal combustion engine which enables a more uniform introduction of gas into an exhaust gas system.

According to the disclosure, this object is, for example, achieved by a gas introduction assembly for introducing gas, in particular air, into an exhaust gas system of an internal combustion engine, including a gas introduction region to be positioned in the interior of an exhaust gas system and constructed at least partially with porous material.

As a result of the use of fundamentally gas-permeable material with its porous structure in the gas introduction region, the gas flowing through the pores of the porous material is discharged at the surface of the gas introduction region constructed with the porous material uniformly into the volume which surrounds the gas introduction region. Introduction quantities which vary greatly locally, as occur in the case of gas passage openings provided in a gas introduction region, can thus be avoided. Gas introduced via the gas introduction assembly can thus flow onto subsequent system regions downstream of the gas introduction region, such as, for example, a heating unit or an exhaust gas treatment unit, so that, for example, the heat generated in a heating unit can be discharged from this more uniformly and can be introduced more uniformly into an exhaust gas treatment unit.

In order to be able to provide a chemically and thermally resistant structure, it is proposed that the porous material includes metal material or ceramic material.

For example, the porous material can include:

sintered material, and/or yarn material, preferably knit or textile or knitted fabric or non-woven material, and/or foam material.

Metal material can preferably be used when using sintered material or yarn material. When using foam material, for example, foam ceramic can be used to construct the gas introduction region.

The gas introduction assembly can include a gas introduction body with a gas-permeable body wall.

In this case, the gas permeability of the gas introduction body can be provided for a configuration of the gas introduction assembly constructed with a small number of components in that, in order to provide the gas introduction region, the body wall is constructed at least in regions with porous material.

For example, the body wall can include a circumferential wall extending in the direction of a body wall longitudinal axis, which circumferential wall can be constructed at least in regions with porous material.

For further support of a uniform discharge of gas, the body wall can include a base wall which adjoins the circumferential wall, and the base wall can be constructed at least in regions with porous material.

The effect of uniform distribution of gas to be introduced into an exhaust gas system via the conducting of gas through a body constructed with porous material can, in the case of a further configuration, be obtained in that, in order to provide the gas introduction region, at least one gas-permeable body constructed at least in regions with porous material is arranged in the gas introduction body.

In order to ensure in the case of this configuration that the gas can also flow through the gas introduction body, it is therefore in principle gas-permeable, a multiplicity of gas passage openings can be provided in the body wall.

It should be pointed out in this context that, within the meaning of the present disclosure, a porous structure of a material can be provided by the provision of substantially microscopic openings or ducts in the material. Such openings or ducts which also define the porosity of the material, in contrast to macroscopic gas passage openings incorporated in general via material-removing machining, such as, for example, boring, cutting out, punching out or like, have no rectilinear extension through the material, but rather define angled flow paths for the gas which wind through the thickness of the material constructed with the porous structure.

In order to be able to use the uniform gas discharge generated by the porous material, it is proposed that at least a part of the gas passage openings is at least partially covered by the at least one gas-permeable body.

It can, for example, be provided in this case that the at least one gas-permeable body at least partially covers all the gas passage openings formed in the body wall, and/or the at least one gas-permeable body fully covers at least one gas passage opening formed in the body wall.

The body wall can include a circumferential wall which extends in the direction of a body wall longitudinal axis, and at least a part of the gas passage openings can be formed in the circumferential wall. In order to be able to use the distribution effect of the gas-permeable body, the at least one gas-permeable body, preferably bearing against an inner side of the circumferential wall, can at least partially cover at least one gas passage opening formed in the circumferential wall.

The gas introduction body can furthermore be constructed such that the body wall includes a circumferential wall extending in the direction of a body wall longitudinal axis and at an axial end region of the circumferential wall a base region with at least one gas passage opening. It is particularly advantageous for uniform gas distribution if the at least one gas-permeable body at least partially covers at least one gas passage opening formed in the base region.

In order to cover gas passage openings both in the circumferential wall and in the base region, the gas-permeable body can have a substantially tube-like first gas-permeable body region which covers at least one gas passage opening formed in the circumferential wall and a second gas-permeable body region which covers at least one gas passage opening formed in the base region.

Here, in order to influence the quantities of gas discharged via the circumferential wall on one hand and the base region on the other hand, the at least one gas-permeable body can be formed in the first gas-permeable body region and in the second gas-permeable body region with substantially the same porosity, or the at least one gas-permeable body can be formed in the first gas-permeable body region and in the second gas-permeable body region with porosities which are different from one another.

In the case of an alternative configuration, the at least one gas-permeable body is formed expanding radially in the direction of a gas-permeable body longitudinal axis, preferably in a substantially cone-like manner, and covers with its end region with a larger radial dimension at least one gas passage opening formed in the base region. With this cone-like structure, the gas-permeable body also forms a flow deflection element via which the gas to be introduced via the gas introduction body can be deflected in a defined direction, for example, to gas passage openings provided in a circumferential wall of the gas introduction body.

In order to influence the flow properties, in particular also a throttle effect initiated by the gas-permeable body, the at least one gas-permeable body can be formed as a hollow body, or the at least one gas-permeable body can be formed as a solid body. It should be pointed out that, within the meaning of the present disclosure, a solid body is a body in which substantially the entire volume occupied by an enveloping thereof is occupied with the porous structure material of the body.

The disclosure furthermore relates to an exhaust gas system for an internal combustion engine, including an exhaust gas-conducting component, which provides an exhaust gas duct, and at least one gas introduction assembly constructed according to the disclosure and arranged with its gas introduction region in the exhaust gas duct.

At least one heating unit and/or at least one exhaust gas treatment unit can be arranged downstream of the at least one gas introduction assembly.

BRIEF DESCRIPTION OF DRAWINGS

The invention will now be described with reference to the drawings wherein.

DETAILED DESCRIPTION

Figure 1:
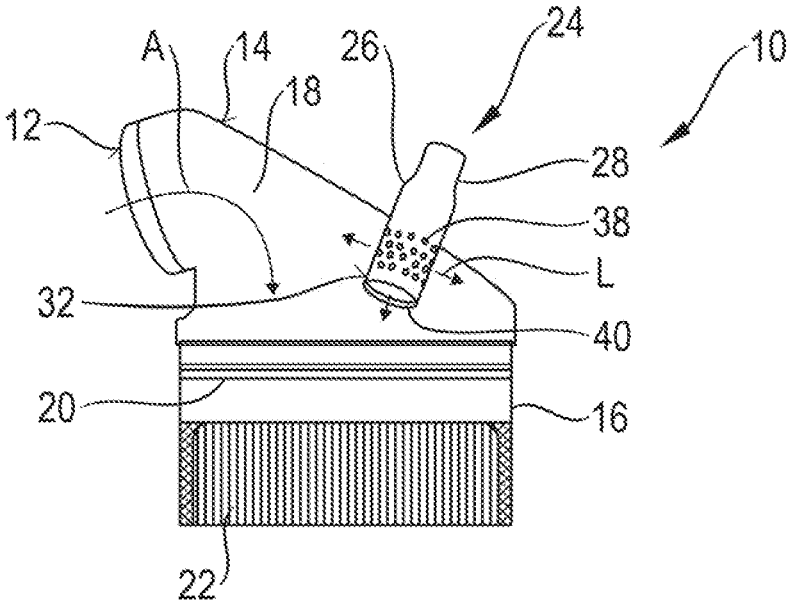
FIG. 1 shows, in a principle-type representation, a portion of an exhaust gas system for an internal combustion engine.

A portion of an exhaust gas system designated generally by 10 for an internal combustion engine, for example, in a vehicle is represented in FIG. 1. The portion represented in FIG. 1 of the exhaust gas system 10 shows three exhaust gas-conducting components 12, 14, 16 which adjoin one another. The exhaust gas-conducting component 12 formed, for example, in a tube-like manner conducts the exhaust gas A output by an internal combustion engine to the exhaust gas-conducting component 14 formed in a hood-like or hopper-like manner. The exhaust gas flows via the exhaust gas-conducting component 14 which provides an exhaust gas duct 18 for the exhaust gas A to the exhaust gas-conducting component 16 which is formed in a tube-like or housing-like manner and in which a heating unit 20 and an exhaust gas treatment unit 22, for example, a catalytic converter, are arranged consecutively in the direction of flow. In the transition from the tube-like exhaust gas-conducting component 12 to the, for example, exhaust gas-conducting component 16 likewise formed in a tube-like manner, the exhaust gas-conducting component 14 formed in a hood-like or hopper-like manner on one hand provides a cross-sectional expansion, and provides on the other hand a flow deflection for the exhaust gas A conducted in the direction of the exhaust gas treatment unit 22.

During operation of an internal combustion engine, the exhaust gas A conducted in the direction of the exhaust treatment unit 22 can absorb heat in the region of the heating unit 20 and transfer it into the exhaust gas treatment unit 22. This is used in particular at the start of the operating period of an internal combustion engine in order to additionally transfer heat to the still comparatively cold exhaust gas A and conduct this heat further into the exhaust gas treatment unit 22 so that the exhaust gas treatment unit 22 can be brought quicker to the temperature required to perform the generally catalytic reaction for treatment of the exhaust gas A. In this regard, the heating unit 22 can include, for example, one or more heating conductors which can be heated by applying an electrical voltage.

In order, in particular in an operating phase in which an internal combustion engine is not yet in operation and therefore exhaust gas A does not flow through the exhaust gas system 10, to already preheat the exhaust gas treatment unit 22 or bring it to a temperature which lies in the range of the temperature for carrying out the catalytic reaction, a gas L, for example, air, can be introduced via a gas introduction assembly referred to generally by 24 upstream of the heating unit 20 and the exhaust gas treatment unit 22 into the exhaust gas system 10 or the exhaust gas duct 18. This gas L flows through or around the heating unit 20 and can absorb heat generated therein and carry this in the direction of the downstream exhaust gas treatment unit 22.

Figure 2:
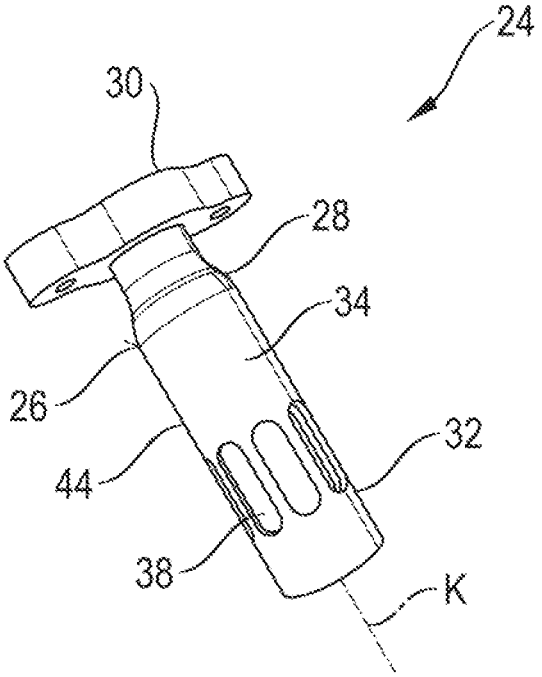
FIG. 2 shows, in a perspective view, a gas introduction assembly which can be used in the case of an exhaust gas system of FIG. 1.
Figure 3:
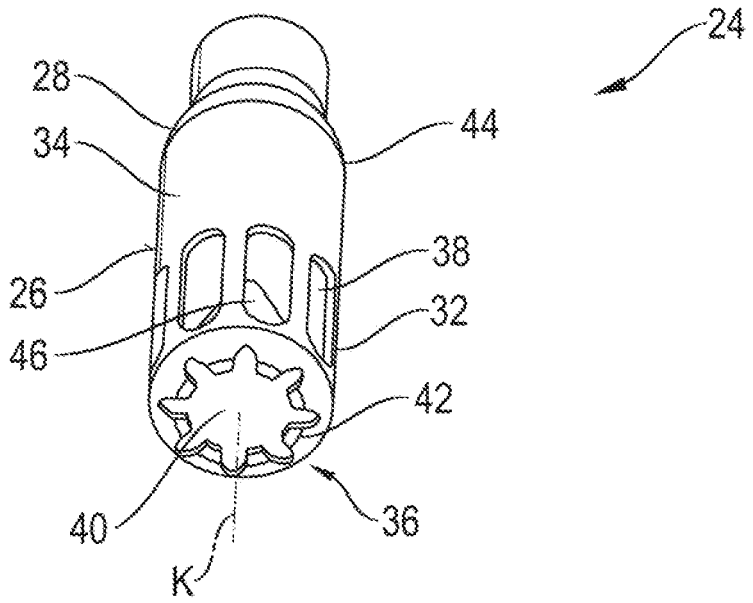
FIG. 3 shows another perspective view of the gas introduction assembly of FIG. 2.
Figure 4:
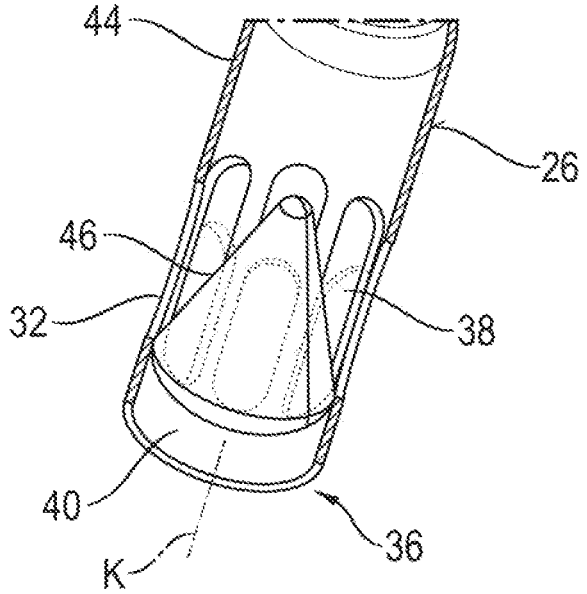
FIG. 4 shows the gas introduction assembly of FIGS. 2 and 3 in a sectional representation.
Figure 5:
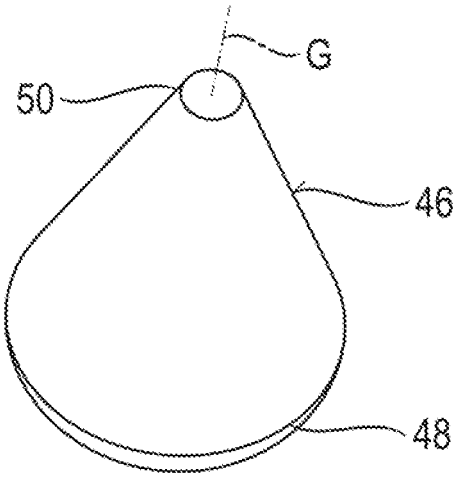
FIG. 5 shows a gas-permeable body of the gas introduction assembly of FIGS. 2 to 4.

The gas introduction assembly 24 includes a gas introduction body 26 formed in a tube-like manner which, as illustrated in FIG. 2, can be formed in a connecting region 28 which lies outside the exhaust gas system 10 or the exhaust gas duct 18 for connection to a gas feed line and in this region can have, for example, a connecting flange 30. In a gas introduction region 32 which extends in the interior of the exhaust gas-conducting component 14 or in the exhaust gas duct 18, the gas introduction body 26 has in a circumferential wall 34 thereof and, as is apparent in FIG. 3, also in a base region 36 thereof a multiplicity of gas passage openings 38, 40. While, in the configuration example represented in FIG. 1, these gas passage openings 38, 40 are formed with a substantially circular opening cross-section, in the configuration example illustrated in FIGS. 2 and 3, the gas passage openings 38 formed in the circumferential wall 34 are longitudinally extended substantially in the direction of a body wall longitudinal axis K of a body wall of the gas introduction body 26 which includes the circumferential wall 34 and in the configuration example illustrated in FIGS. 2 and 3 a base wall 42. In the case of this configuration example illustrated in FIGS. 2 and 3, the gas passage opening 40 formed in the base region 36 or the base wall 42 is formed with a substantially star-shaped configuration. In the case of the variant illustrated in FIG. 4, the base region 36 or the gas passage opening 40 can be provided there in that the tube-like circumferential wall 34 of the body wall 44 is axially open, therefore no cross-sectional restriction formed by a base wall is present in this region.

A gas-permeable body 46 is arranged in the gas introduction body 26 of the gas introduction assembly 24 in the configuration example illustrated in FIGS. 2 to 5. The gas-permeable body 46 has a substantially cone-like configuration and is arranged in the gas introduction body so that its axial end region 48 in the direction of the gas-permeable body longitudinal axis G with a larger axial dimension lies closer to the base region 36 than its axial end region 50 with a smaller radial dimension. In particular, the gas-permeable body 46 is arranged inside the body wall 44 so that its axial end region 48 with a larger radial dimension is positioned downstream of the gas passage openings 38 formed in the circumferential wall 34 and in this region bears against the inner side of the circumferential wall 34 and is fixed thereon, for example, by interference fit and/or material connection, such as, for example, bonding, soldering or welding. Since the gas-permeable body 46 preferably occupies with its axial end region 48 with a larger radial dimension the entire inner cross-section of the substantially cylindrically formed circumferential wall 34, the gas-permeable body 46 fully covers the gas passage opening 40 formed on the base region 36.

The gas-permeable body 46 is constructed with porous material which is in principle permeable for the gas L introduced into the gas introduction body 26. The gas L which flows from the connecting region 28 in the direction of the gas introduction region 32 arrives at the gas-permeable body 46 which expands radially in the direction of the body wall longitudinal axis K and is, as a result of its in principle radially expanding, cone-like structure, diverted partially radially outwards in the direction of the gas passage openings 38 provided in the circumferential wall 34. Since the gas-permeable body 46 is preferably dimensioned so that it extends in the direction of the body wall longitudinal axis K in the entire portion of the circumferential wall 34 having the gas passage openings 38, a substantially uniform diversion of the gas L radially outwards towards the gas passage openings 38 in the circumferential wall is achieved. This part of the gas L can thus flow through the body wall 44, which is fundamentally gas-permeable as a result of the provision of the gas passage openings 38, 40, into the exhaust gas duct 18 of the exhaust gas system 10.

A part of the gas introduced into the gas introduction body 26 flows through the porous and thus gas-permeable body 46 and travels through the gas passage opening 40 covered by it in the base region 36 into the exhaust gas duct 18. This leads to a very uniform discharge of gas L on one hand in the radial direction and on the other hand in the axial direction in relation to the body wall longitudinal axis K so that the gas L introduced via the gas introduction assembly 24 into the exhaust gas duct 18 can flow in a uniform manner onto the heating unit 20 which is downstream in the direction of flow and can discharge heat from it substantially uniformly via its cross-section and transport it in the direction of the exhaust gas treatment unit 22.

Metal material or ceramic material can be used for constructing the porous gas-permeable body 46 as a result of the required temperature resistance and chemical resistance. In order to obtain the porous structure, this material can be provided as a sintered material or in particular in the case of ceramic material as foam ceramic. The use of yarn-like material, for example, wire material, such as, for example, a knitted fabric, a knit, non-woven material or a textile is possible.

By providing this porous structure of the gas-permeable body 46 with a plurality of microscopic ducts or openings via which the gas L can be discharged into the exhaust gas duct 18 on the surface of the gas-permeable body 46, a significantly more uniform gas discharge is achieved in comparison with conducting through macroscopic openings. The deflection action introduced by the porous gas-permeable body 46 also evens out the discharge of gas L through the gas passage openings 38, to be considered as macroscopic openings, in the circumferential wall 34 across its entire length.

The porosity of the gas-permeable body 46 can be selected depending on the quantity of gas which is supposed to pass through it. The greater the quantity of gas, the greater a porosity can be selected. In this case, the gas-permeable body 46 can be formed as a solid body which is constructed in the entire volume surrounded by its enveloping with the porous material. Alternatively, the gas-permeable body 46 can be formed as a hollow body, in the case of which a wall, providing the cone-like structure, thereof is constructed with the porous material, but substantially no further material is present in the volume surrounded by this wall.

Figure 6:
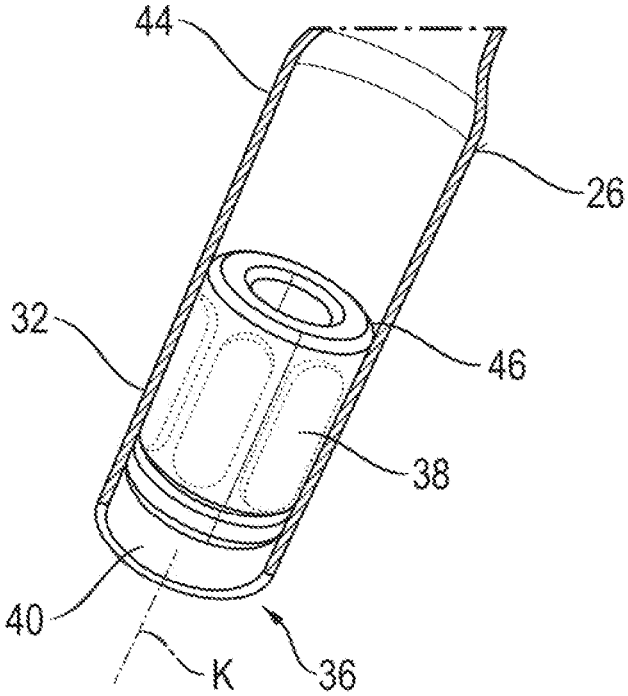
FIG. 6 shows a representation corresponding to FIG. 4 with an alternative type of configuration of a gas-permeable body.
Figure 7:
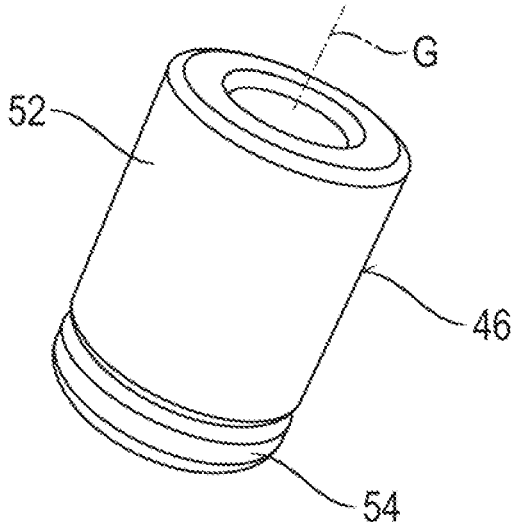
FIG. 7 shows the gas-permeable body of the gas introduction assembly of FIG. 6 in a perspective view; and, FIG. 8 shows a perspective representation of a further alternative type of configuration of a gas introduction assembly.

FIGS. 6 and 7 illustrate an alternative type of configuration of the gas introduction assembly 24 or of the gas-permeable body 46 formed with porous material. In the configuration example represented in FIGS. 6 and 7, the gas-permeable body 46, adapted to the substantially cylindrical configuration of the circumferential wall 34, has an also substantially cylindrical outer circumferential contour so that it, in the longitudinal region of the circumferential wall 34 covered by it, bears against the inner surface thereof and is held thereon, for example, by interference fit and/or material connection. The gas-permeable body 46 thus covers all the gas passage openings 38 provided in the circumferential wall 34 preferably in its entire longitudinal region so that a uniform discharge of the gas L into the exhaust gas duct 18 can be achieved by the gas-permeable body 46 constructed with the porous structure in the region of each gas passage opening 38.

It is apparent in FIGS. 6 and 7 that the gas-permeable body 46 is formed with a tube-like first gas-permeable body region 52 which covers the gas passage openings 38 in the circumferential wall 34 and a base-like or cover-like second gas-permeable body region 54 adjoining thereon in the direction of the gas-permeable body longitudinal axis G. The second gas-permeable body region 54 covers the gas passage opening 40 formed in the base region 36 so that all of the gas passage openings 38, 40 provided with the fundamentally pot-like structure of the gas-permeable body 46 in the body wall 44 of the gas introduction body 26 are substantially fully covered and in the region of each of these gas passage openings 38, 40 gas is discharged in a uniform manner via the porous structure of the gas-permeable body 46.

The gas-permeable body 46 can be provided in one piece, that is, monolithically with its two gas-permeable body regions 52, 54, that is, as one material block, which leads to it having the same porosity substantially in its entire inner volume region. In the case of an alternative configuration, the two gas-permeable body regions 52, 54 can be provided by parts provided separately from one another and positioned connected to one another or adjoining one another, which parts can then be provided with different construction materials and/or different porosities. Should a larger quantity of the gas L be discharged, for example, via the gas passage openings 38, the porosity of the first gas-permeable body region 52 can be selected to be greater than the porosity of the second gas-permeable body region 54. Should a larger quantity of the gas L be discharged via the base region 36 or the gas passage opening 40 provided there, the porosity of the second gas-permeable body region 54 can be selected to be greater than the porosity of the first gas-permeable body region 52.

Figure 8:
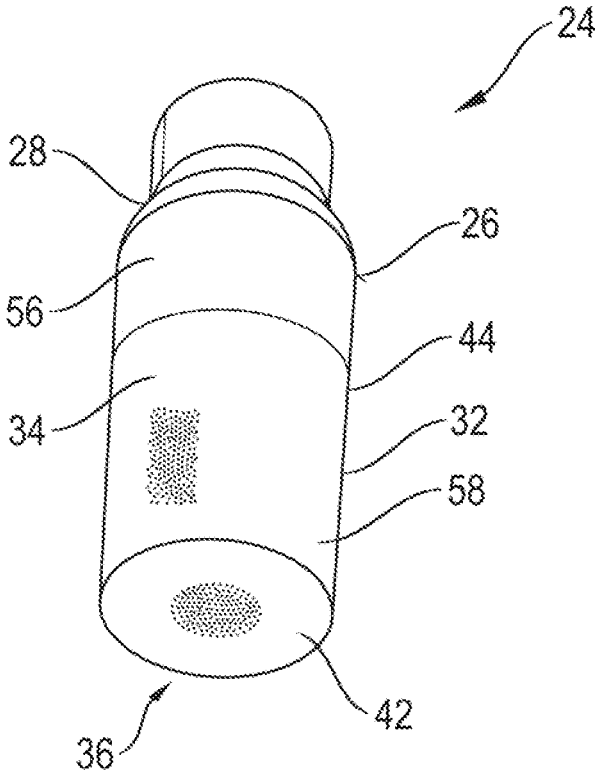

A further alternative type of configuration of a gas introduction assembly 24 is illustrated in FIG. 8. In the case of the type of configuration of the gas introduction assembly 24 represented in FIG. 8, the gas introduction body 26 is formed in particular in its gas introduction region 32 with a body wall 44 with a porous structure, that is, with porous material. This is realized by the porous structure of the body wall 44 indicated in regions in the circumferential wall 34 and the base wall 42.

In order to ensure in the case of this configuration that in particular in the connecting region 28 a gas leak does not occur, the gas introduction body 26 or its body wall 44 can be formed with a first body wall part 56, which provides the connecting region 28, for example, from a non-porous metal material and a second body wall part 58, which provides the porous gas introduction region 32. These can be connected to one another, for example, by material connection.

With the configuration represented in FIG. 8, it becomes possible to achieve a very uniform discharge of gas L into the exhaust gas duct 18 substantially over the entire surface region of the circumferential wall 34 and the base wall 42 of the body wall 44 in the gas introduction region 32.

It is understood that the foregoing description is that of the preferred embodiments of the invention and that various changes and modifications may be made thereto without departing from the spirit and scope of the invention as defined in the appended claims.

The invention claimed is:

1. A gas introduction assembly for introducing a gas into an exhaust gas system of an internal combustion engine, the exhaust gas system having an interior and the gas introduction assembly comprising:

a gas introduction region to be positioned in said interior of said exhaust gas system and being made, at least partially, of porous material, said gas introduction region including a gas introduction body having a gas-permeable body wall defining a longitudinal axis (K) and including a circumferential wall extending in a direction of said longitudinal axis (K), said body wall having a plurality of gas passage openings provided therein, at least a part of said gas passage openings being formed in said circumferential wall, said gas introduction region comprising at least one gas-permeable body arranged in said gas introduction body and made, at least in regions thereof, with porous material, said at least one gas-permeable body at least partially covering at least one gas passage opening formed in said circumferential wall.

2. The gas introduction assembly of claim 1, wherein said gas is air.

3. The gas introduction assembly of claim 1, wherein said porous material comprises at least one of what follows: metal material or ceramic material and/or the porous material comprises sintered material, yarn material, knit or textile or knitted fabric, non-woven material and/or foam material.

4. The gas introduction assembly of claim 1, wherein at least one of what follows applies:

i) said at least one gas-permeable body at least partially covers all of said gas passage openings formed in said body wall; and, ii) said at least one gas-permeable body fully covers at least one gas passage opening formed in said body wall.

5. The gas introduction assembly of claim 1, wherein said circumferential wall has an inner side; and, said gas-permeable body bears against said inner side of said circumferential wall.

6. The gas introduction assembly of claim 1, wherein said body wall defines a base region arranged at an axial end region of said circumferential wall; said base region has at least one gas passage opening; and, said at least one gas-permeable body at least partially covers said at least one gas passage opening formed in said base region.

7. The gas introduction assembly of claim 6, wherein said gas-permeable body has a tube-like first gas-permeable body region covering at least one of said gas passage openings formed in said circumferential wall and a second gas-permeable body region covering said at least one gas passage opening formed in said base region.

8. The gas introduction assembly of claim 7, wherein one of what follows applies:

i) said at least one gas-permeable body is formed in said first gas-permeable body region and in said second gas-permeable body region with the same porosity; or, ii) said at least one gas-permeable body is formed in said first gas-permeable body region and in said second gas-permeable body region with porosities different from each other.

9. The gas introduction assembly of claim 6, wherein said gas-permeable body defines a longitudinal axis (G) and is formed expanding radially in a direction of said longitudinal axis (G) from an axial end region of said gas-permeable body with a smaller radial extension to an axial end region of said gas-permeable body with a larger radial extension; and, said gas-permeable body covers, with said end region, with a larger radial extension, at least one gas passage opening formed in said base region.

10. The gas introduction assembly of claim 9, wherein said gas-permeable body is formed extending radially in the direction of said longitudinal axis (G) in a cone-like manner.

11. The gas introduction assembly of claim 1, wherein one of the following applies:

i) said at least one gas-permeable body is formed as a hollow body; or, ii) said at least one gas-permeable body is formed as a solid body.

12. An exhaust gas system for an internal combustion engine, the exhaust gas system comprising:

an exhaust gas-conducting component including an exhaust gas duct defining an interior;

at least one gas introduction assembly having a gas introduction region;

said at least one gas introduction assembly being arranged with said gas introduction region in said interior of said exhaust gas duct; and, said gas introduction region being made, at least partially, of porous material, said gas introduction region including a gas introduction body having a gas-permeable body wall defining a longitudinal axis (K) and including a circumferential wall extending in a direction of said longitudinal axis (K), said body wall having a plurality of gas passage openings provided therein, at least a part of said gas passage openings being formed in said circumferential wall, said gas introduction region comprising at least one gas-permeable body arranged in said gas introduction body and made, at least in regions thereof, with porous material, said at least one gas-permeable body at least partially covering at least one gas passage opening formed in said circumferential wall.

13. The exhaust gas system of claim 12, further comprising at least one of the following:

i) at least one heating unit; and, ii) at least one exhaust gas treatment unit arranged downstream of said at least one gas introduction assembly.

14. A gas introduction assembly for introducing a gas into an exhaust gas system of an internal combustion engine, the exhaust gas system having an interior and the gas introduction assembly comprising:

a gas introduction region to be positioned in said interior of said exhaust gas system and being made, at least partially, of porous material, said gas introduction region comprising a gas introduction body having a gas-permeable body wall defining a longitudinal axis (K) and including a circumferential wall extending in a direction of said longitudinal axis (K) and a base region arranged at an axial end region of said circumferential wall, said body wall having a plurality of gas passage openings provided therein for a delivery of gas from the gas introduction body, said base region having at least one of said gas passage openings;

said gas introduction region comprising at least one gas-permeable body arranged in said gas introduction body and made, at least in regions thereof, with porous material, said at least one gas-permeable body at least partially covering said at least one gas passage opening formed in said base region.

15. A gas introduction assembly for introducing a gas into an exhaust gas system of an internal combustion engine, the exhaust gas system including an exhaust gas flow path and the gas introduction assembly comprising:

a gas introduction region to be positioned in said exhaust gas flow path and being made, at least partially, of porous material, said gas introduction region comprising a gas introduction body having a gas-permeable body wall defining a longitudinal axis (K) and including a circumferential wall extending in a direction of said longitudinal axis (K), said body wall having a plurality of gas passage openings provided therein for a delivery of gas from the gas introduction body into said exhaust gas flow path.

* * * * *